US012709369B2

(12) United States Patent
Lee

(10) Patent No.: US 12,709,369 B2
(45) Date of Patent: Aug. 18, 2026

(54) COMBINATION TRIM TAB AND PROPULSION UNIT

(71) Applicant: ROSWELL CANADA INC., Acheson (CA)

(72) Inventor: Bruce Lee, Merritt Island, FL (US)

(73) Assignee: ROSWELL CANADA INC., Acheson (CA)

( * ) Notice: Subject to any disclaimer, the term of this patent is extended or adjusted under 35 U.S.C. 154(b) by 658 days.

(21) Appl. No.: 18/126,578

(22) Filed: Mar. 27, 2023

(65) Prior Publication Data

US 2023/0303226 A1 Sep. 28, 2023

Related U.S. Application Data

(60) Provisional application No. 63/323,566, filed on Mar. 25, 2022.

(51) Int. Cl.
*B63H 5/15* (2006.01)
*B63H 5/125* (2006.01)

(52) U.S. Cl.
CPC ..... *B63H 5/15* (2013.01); *B63H 5/125* (2013.01)

(58) Field of Classification Search
CPC ..... B63H 5/125; B63H 5/15
See application file for complete search history.

(56) References Cited

U.S. PATENT DOCUMENTS

| | | | | |
|---|---|---|---|---|
| 3,171,379 | A * | 3/1965 | Schell, Jr. | B63H 11/14 60/221 |
| 3,307,358 | A * | 3/1967 | Kerandraon | B63H 1/30 60/221 |
| 3,650,310 | A | 3/1972 | Childress | |
| 3,972,301 | A | 8/1976 | Protta | |
| 4,832,642 | A | 5/1989 | Thompson | |
| 5,545,063 | A * | 8/1996 | Haynes | B63H 11/103 440/47 |
| 5,704,308 | A * | 1/1998 | Anderson | B63H 20/007 440/6 |
| 5,841,895 | A | 11/1998 | Huffman | |
| 5,878,686 | A | 3/1999 | Anderson | |
| 6,341,993 | B1 * | 1/2002 | Lalli, Jr. | A63B 31/11 441/64 |
| 6,520,813 | B1 | 2/2003 | Devito, Jr. | |
| 6,677,889 | B2 | 1/2004 | Van Rees et al. | |
| 6,823,812 | B2 | 11/2004 | Von Wolske | |
| 6,863,581 | B2 | 3/2005 | Anderson | |
| 7,381,108 | B1 | 6/2008 | Salmon | |
| 7,467,596 | B2 | 12/2008 | Salmon | |
| 2015/0329188 | A1 | 11/2015 | Downs | |

* cited by examiner

*Primary Examiner* — Stephen P Avila
(74) *Attorney, Agent, or Firm* — Timothy H. Van Dyke; Wolter Van Dyke Davis, PLLC

(57) ABSTRACT

An apparatus, including at least one trim tab assembly (100), each including: a mounting base (110) configured to be mounted to a stern of a marine vessel; a trim tab (112) including a nozzle (150); a pivot joint (114) configured to raise and lower the trim tab relative to the mounting base; and an axial flow pump (140) configured to direct a medium flow through the nozzle.

23 Claims, 8 Drawing Sheets

COMBINATION TRIM TAB AND PROPULSION UNIT

FIELD OF THE INVENTION

The invention relates to a combination trim tab and propulsion unit.

BACKGROUND OF THE INVENTION

Trim tabs on marine vessels use control surfaces to help control pitch and roll during various operating conditions. The industry has added further functionality in some instances by incorporating propulsion units. While these combined trim tab propulsion units improve vessel control, there remains room for improvement.

BRIEF DESCRIPTION OF THE DRAWINGS

The invention is explained in the following description in view of the drawings that show.

DETAILED DESCRIPTION OF THE INVENTION

The present inventor has devised a unique and innovative, low profile, combined trim tab and propulsion unit. The combined unit acts like a conventional trim tab at relatively high speeds. At relatively low speeds, the combined unit provides propulsion capable of aiding in maneuvering the marine vessel and may further be articulated to provide lateral thrust. In addition, two or more combined units may be used together as part of a trim tab system to provide additional maneuvering control.

Figure 1:
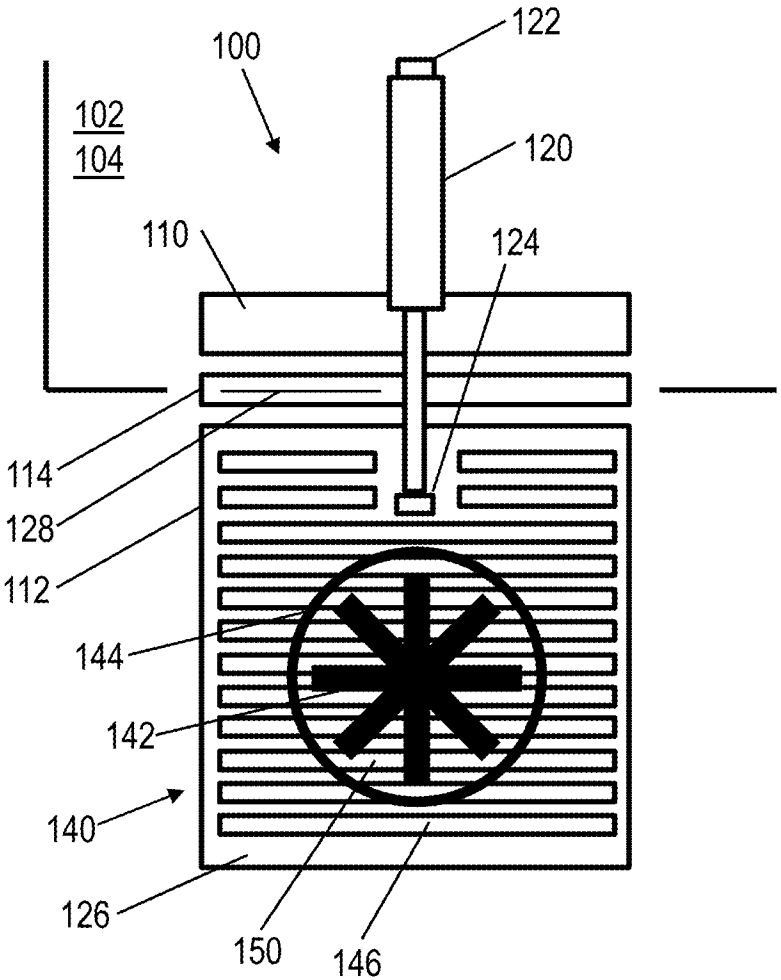
FIG. 1 is a schematic rear view of an example embodiment of a trim tab assembly.

FIG. 1 is a schematic rear view of an example embodiment of a trim tab assembly 100 mounted to a stern 102 of a marine vessel 104. The trim tab assembly 100 includes a mounting base 110, a trim tab 112, and a pivot joint 114. An actuator 120 (e.g., a linear actuator) includes a base pivot mount 122 secured to the stern 102 and a tip pivot mount 124 secured to a dorsal side 126 of the trim tab 112. Extending and retracting the actuator 120 respectively lowers and raises the trim tab 112 by pivoting the trim tab 112 about a pivot axis 128. An axial flow pump 140 (e.g., a bidirectional ducted fan) having a propeller 142 and optionally a surrounding duct 144 is mounted on the dorsal side 126 of the trim tab 112.

Openings 146 pass entirely through the trim tab 112. The openings 146 may take the form of the slits shown in FIG. 1, circular holes shown in FIG. 5, and/or any other suitable shape. The openings 146 allow the local medium, (e.g., water), to pass through the trim tab 112. When the axial flow pump 140 is active, a flow of water ejected therefrom will either pass through the trim tab 112 (from the dorsal side 126 to a ventral side 148) or cause water to be drawn through the trim tab 112 in the opposite direction, depending on which direction the propeller 142 is turning.

At least openings 146 within the flow area, (e.g., within the area defined by the duct 144 and in the line of flow of the axial flow pump 140), are configured as nozzles 150. The nozzles 150 may be configured to redirect the flow of water passing through the trim tab 112. The nozzles 150 may have different diameters, may be configured to narrow/constrict and/or widen in one direction or another, either locally or globally, and/or may be oriented differently relative to each other, to generate a desired resulting flow (or flows) that emanates from the trim tab 112. Openings 146 outside the flow area permit water to pass through the trim tab 112 as the trim tab 112 moves through the water at relatively low speeds, thereby reducing a drag of the trim tab 112.

Figure 2:
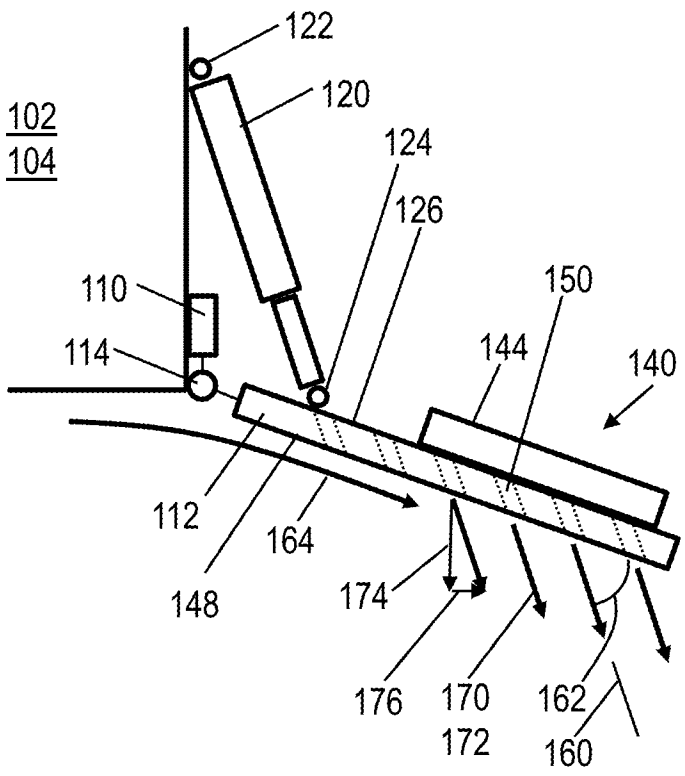
FIG. 2 is a schematic side view of the trim tab assembly of FIG. 1.

As can be seen in FIG. 2, the openings 146 in this example embodiment define an opening longitudinal axis 160 that forms an acute angle 162 with the ventral side 148 of the trim tab 112. From the dorsal side 126 to the ventral side 148, the opening longitudinal axis 160 is angled away from the pivot joint 114, which angles them aft/rearward relative to the marine vessel 104 when the trim tab 112 is in the position shown. When the marine vessel 104 is moving through the water, this acute angle 162 makes is possible for the water 164 to pass over the openings 146. Consequently, at relatively high speeds, the trim tab 112 functions like a conventional trim tab. When the axial flow pump 140 is pushing water through the trim tab 112, each ventral jet 170 emanating from the trim tab 112 is ejected at a respective ventral vector 172. Each ventral vector 172 has a respective vertical vector component 174 that and a respective horizontal vector component 176. Water can be ejected from the openings 146 when the marine vessel 104 is moving at high speeds to aid in water flow along the ventral side 148.

Figure 3:
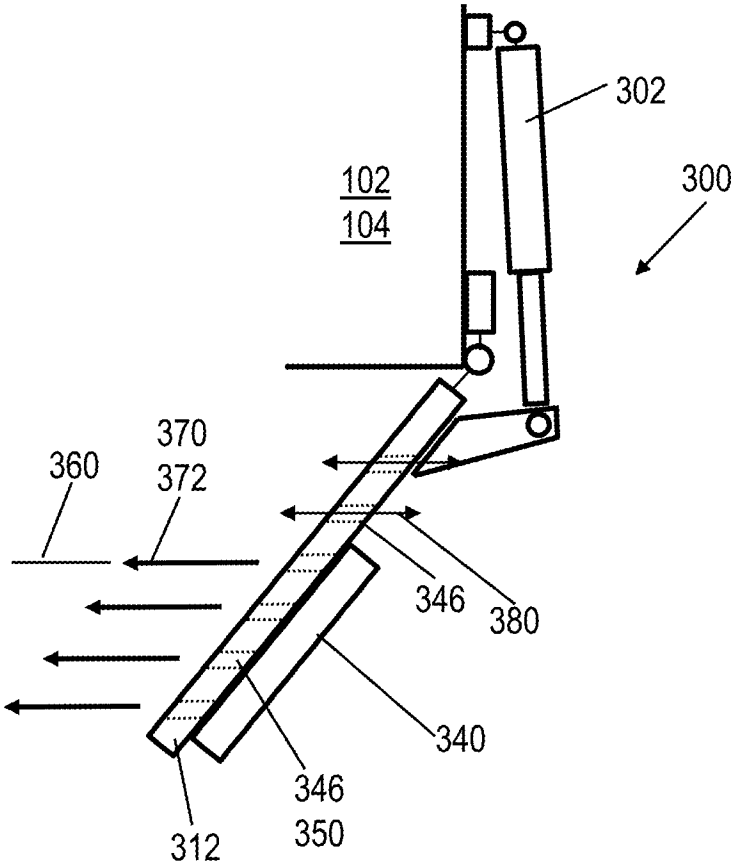
FIG. 3 is a schematic rear view of an alternate example embodiment of a trim tab assembly.

FIG. 3 is a schematic rear view of an alternate example embodiment of a trim tab assembly 300. In this example embodiment, trim tab assembly 300 is configured so that the actuator 320 can pivot the trim tab 312 beyond the vertical position enough so that the openings 346, and/or the nozzles 350, are oriented horizontally. Orienting the nozzles 350 and respective longitudinal axes 360 horizontally results in ventral jets 370 with horizontal ventral vectors 372 when the axial flow pump 340 is pushing water through the nozzles 350. A horizontal ventral vector 372 is advantageous because all of the resulting thrust is parallel to horizontal. Consequently, all the thrust is used for propulsion. The ability to position the trim tab 312 as shown in FIG. 3 is therefore advantageous when the marine vessel 104 is to be moved aft.

When the marine vessel 104 is moving aft, openings 346 other than nozzles 350 allow water to flow through the trim tab 312 via paths 380. This reduces drag caused be the trim tab 312 moving through the water.

Figure 4:
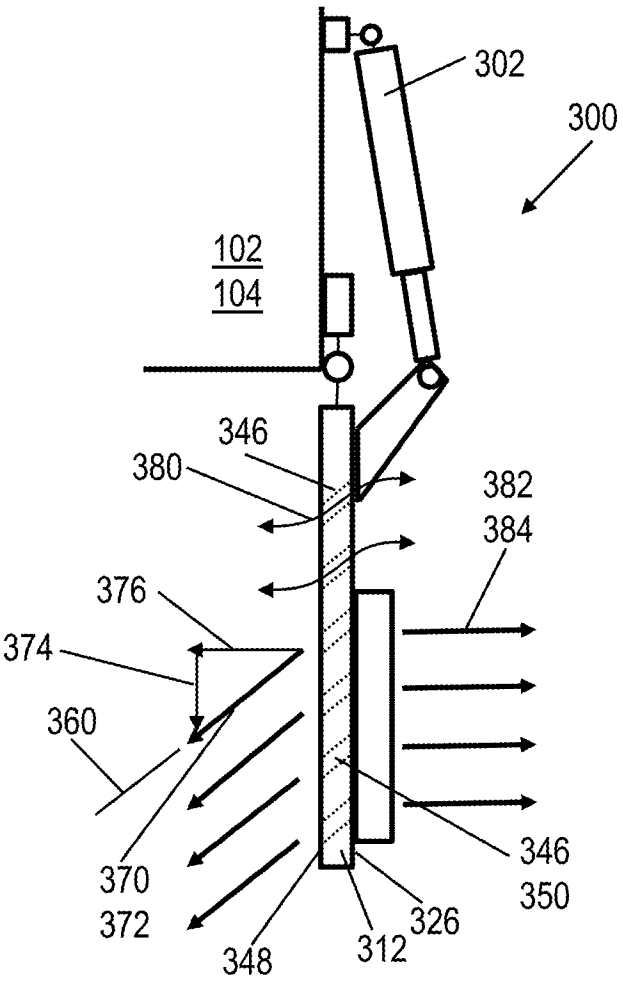
FIG. 4 is a schematic side view of the trim tab assembly of FIG. 3.

FIG. 4 shows the trim tab assembly 300 in a vertical position. If the axial flow pump 340 turns in the same direction as in FIG. 3, the resulting ventral vector 372 is not parallel to horizontal. The horizontal vector 376 will still generate thrust and associated propulsion that will urge the marine vessel 104 aft, but the associated thrust/propulsion will be less than when the trim tab 312 is in the position shown in FIG. 3. The vertical vector 374 will generate vertical thrust, but since the vertical thrust is perpendicular to the desired movement, the thrust will not result in propulsion.

If the axial flow pump 340 changes direction and draws water through the trim tab 312 from the ventral side 348 to the dorsal side 326, dorsal jets 382 are generated. The dorsal jets 382 will have a horizontal dorsal vector 384 when the trim tab 312 is vertical as shown. Here again, a horizontal dorsal vector 384 is advantages because all the resulting thrust is parallel to horizontal. Consequently, all the thrust is used for propulsion. The ability to position the trim tab 312 vertically as shown in FIG. 4 is therefore advantageous when the marine vessel 104 is to be moved forward.

Just like when the marine vessel 104 is moving aft, when the marine vessel 10 is moving forward, the openings 346 other than nozzles 350 allow water to flow through the trim tab 312 via the paths 380 to reduce drag.

Figure 5:
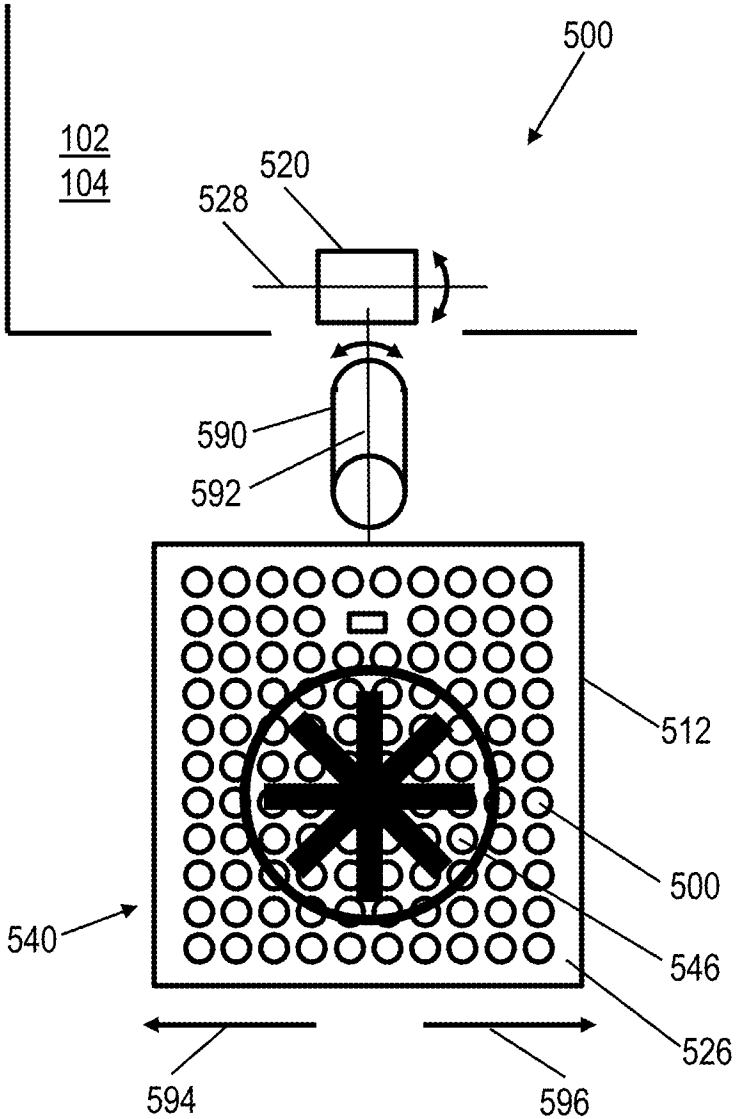
FIG. 5 is a schematic rear view of an alternate example embodiment of a trim tab assembly.

FIG. 5 is a schematic rear view of an alternate example embodiment of the trim tab assembly 500. In this example embodiment, the openings 546 are embodied as round holes. Like the slots/grooves of openings 146, the round holes that act as nozzles may have different diameters, may be configured to narrow/constrict and/or widen in one direction or another, either locally or globally, and/or may be oriented differently, to generate a desired resulting flow (or flows) that emanates from the trim tab 512.

In this example embodiment, a first actuator 520 is shown schematically to move the trim tab 512 about a first pivot axis 528. The first actuator 520 may include a linear actuator and pivot joint like that of FIG. 1. Alternately, the first actuator 520 may include a rotary actuator or any other actuator that raises and lowers the trim tab 512 about any axis that is the first pivot axis 528 (which need not be horizontal) or is parallel to the first pivot axis 528.

Figure 6:
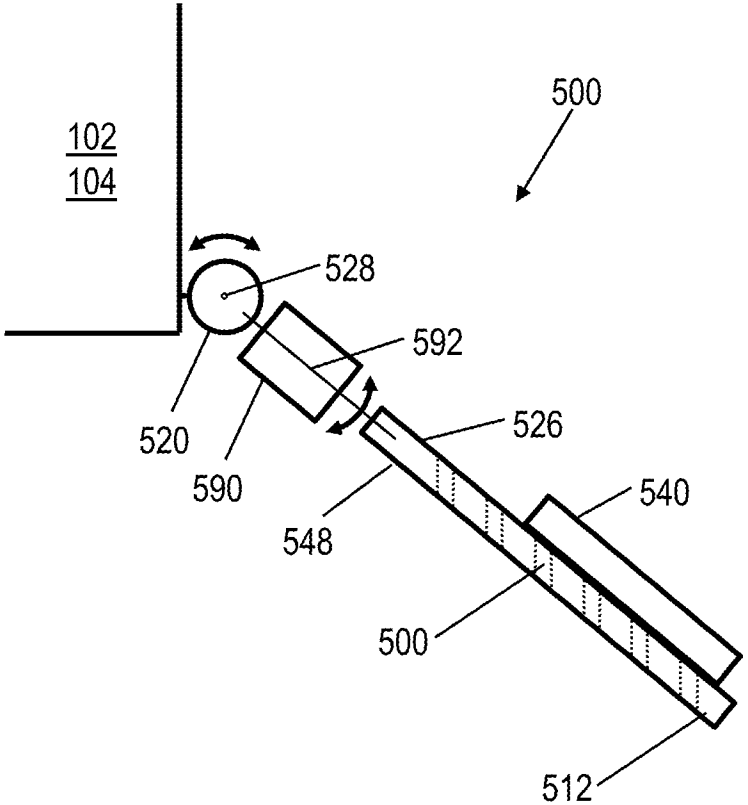
FIG. 6 is a schematic side view of the trim tab assembly of FIG. 5.

In this example embodiment, a second actuator 590 is shown schematically to move the trim tab 512 about a second pivot axis 592. As shown in FIG. 5, the second pivot axis 592 is transverse (not parallel to) to the first pivot axis 528. As can be seen in FIG. 6, in this example embodiment, the second pivot axis 592 is perpendicular to the first pivot axis 528. However, this is not necessary. In an example embodiment, when the trim tab 512 is vertical (as in FIG. 4) and viewed from behind (as in FIG. 5), the second pivot axis 592 appears to cross the to the first pivot axis 528 and may cross at any angle formed therebetween in such a view.

The second actuator 590 may also be a linear actuator with a pivot joint like that of FIG. 1. Alternately, the second actuator may be a rotary actuator or any other actuator that rotates the trim tab 512 about any axis that is not the first pivot axis 528 and is not parallel to the first pivot axis 528.

In various example embodiments, the second actuator 590 can rotate the trim tab 512 ninety (90) degrees from neutral in a clockwise direction and ninety (90) degrees from neutral in a counterclockwise direction. In an example embodiment, the second actuator 590 can rotate the trim tab 512 three hundred sixty (360) degrees.

Rotating the trim tab 512 clockwise (as shown in FIG. 5) up to (but not including) one hundred eighty (180) degrees about the second pivot axis 592 angles the nozzles 546 laterally. Any dorsal jets (from the top of the trim tab 512) created by the axial flow pump 540 would be at least partly angled in a laterally starboard direction 596 (right as shown in FIG. 5) and resulting thrust would propel the stern 102 in a laterally port direction 594 (left as shown in FIG. 5). Conversely, any ventral jets (from the bottom of the trim tab 512) created by the axial flow pump 540 would be at least partly angled in a laterally port direction 594 (left as shown in FIG. 5) and resulting thrust would propel the stern 102 in a laterally starboard direction 596 (right as shown in FIG. 5).

Rotating the trim tab 512 counterclockwise (as shown in FIG. 5) up to (but not including) one hundred eighty (180) degrees about the second pivot axis 592 angles the nozzles 546 laterally. Any dorsal jets (from the top of the trim tab 512) created by the axial flow pump 540 would be at least partly angled in the laterally port direction 594 (left as shown in FIG. 5) and resulting thrust would propel the stern 102 in a laterally starboard direction 596 (right as shown in FIG. 5). Conversely, any ventral jets (from the bottom of the trim tab 512) created by the axial flow pump 540 would be at least partly angled in the laterally starboard direction 596 (right as shown in FIG. 5) and resulting thrust would propel the stern 102 in a laterally port direction 594 (left as shown in FIG. 5).

Since dorsal jets emanate perpendicular to the dorsal surface 526, whereas ventral jets would be angled relative to the ventral surface 548, the dorsal jets would be more effective at generating pure lateral propulsion. However, either can be used to generate lateral movement of the stern 102.

In light of the above it can be understood that example embodiments with the first actuator 520 and the second actuator 590 enable not only pitch and roll control of the marine vessel 104 during relatively high speeds, but also enable forward and aft propulsion of the marine vessel 104, port and starboard propulsion of the stern 102 of the marine vessel 104, and even upward thrust (vector components 174, 374 in FIG. 2 and FIG. 4 respectively) and downward thrust (vertically angled dorsal jets 382 such as in FIG. 2) on the stern 102. In this manner, each trim tab assembly resembles a combination trim tab and small outboard/trolling motor but with greater ranges of motion about each pivot axis than the outboard motor.

Figure 8:
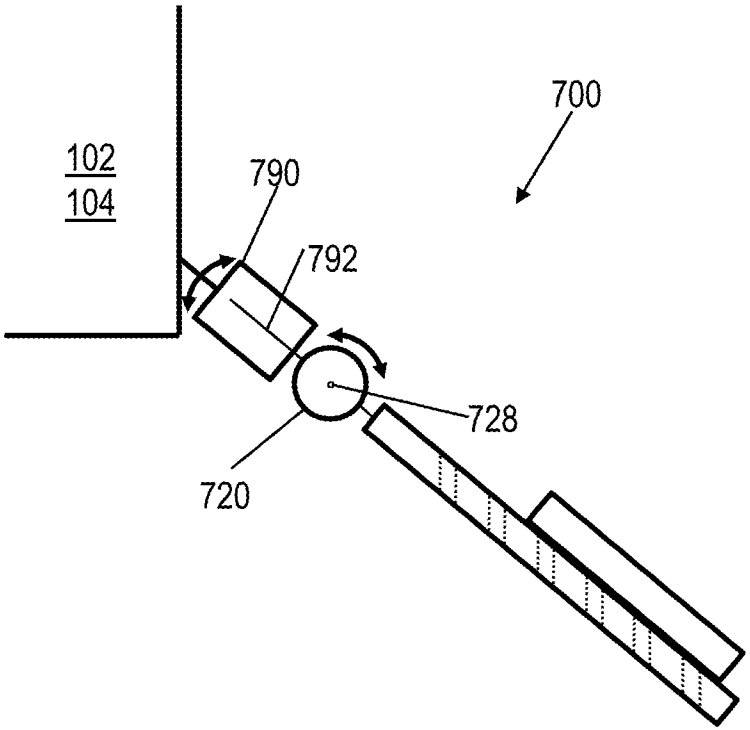
FIG. 8 is a schematic side view of the trim tab assembly of FIG. 7.
Figure 7:
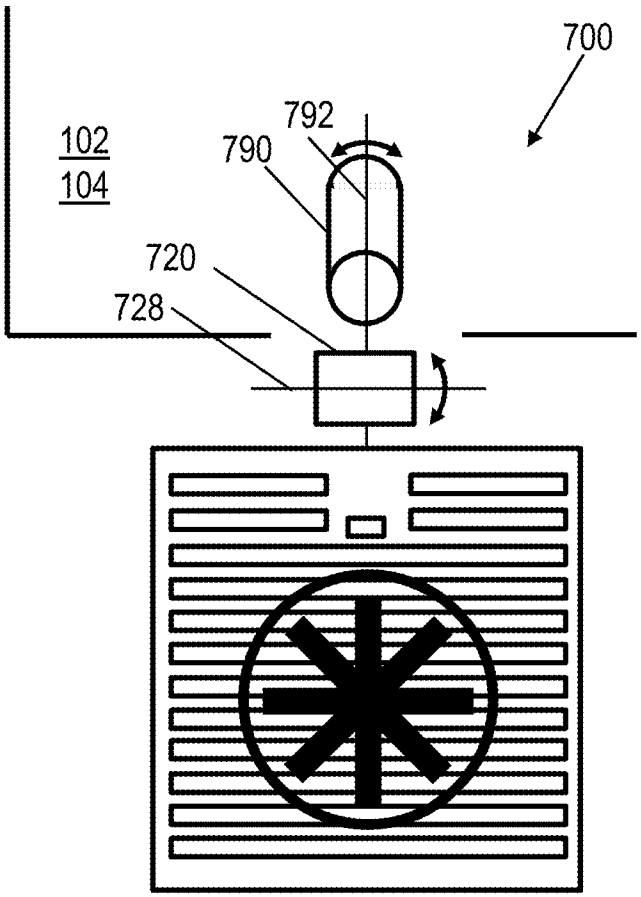
FIG. 7 is a schematic rear view of an alternate example embodiment of a trim tab assembly.

FIG. 7 is a schematic rear view of an alternate example embodiment of the trim tab assembly 700. FIG. 8 is a schematic side view of the trim tab assembly 700. This example embodiment includes all the functionality of the example embodiment of FIG. 5. However, in this example embodiment, the actuators have switched positions. Here, the second actuator 790 is secured to the stern 102 of the marine vessel 104, and the first actuator 720 is disposed between the second actuator 790 and the trim tab 712. As above, the actuators may be linear and/or rotary actuators. Alternately, or in addition, a single combination actuator may be used to achieve the freedom of motion associated with this example embodiment. Any combination of actuators that achieves the convention tilting up and down plus the lateral orientations is acceptable.

Figure 9:
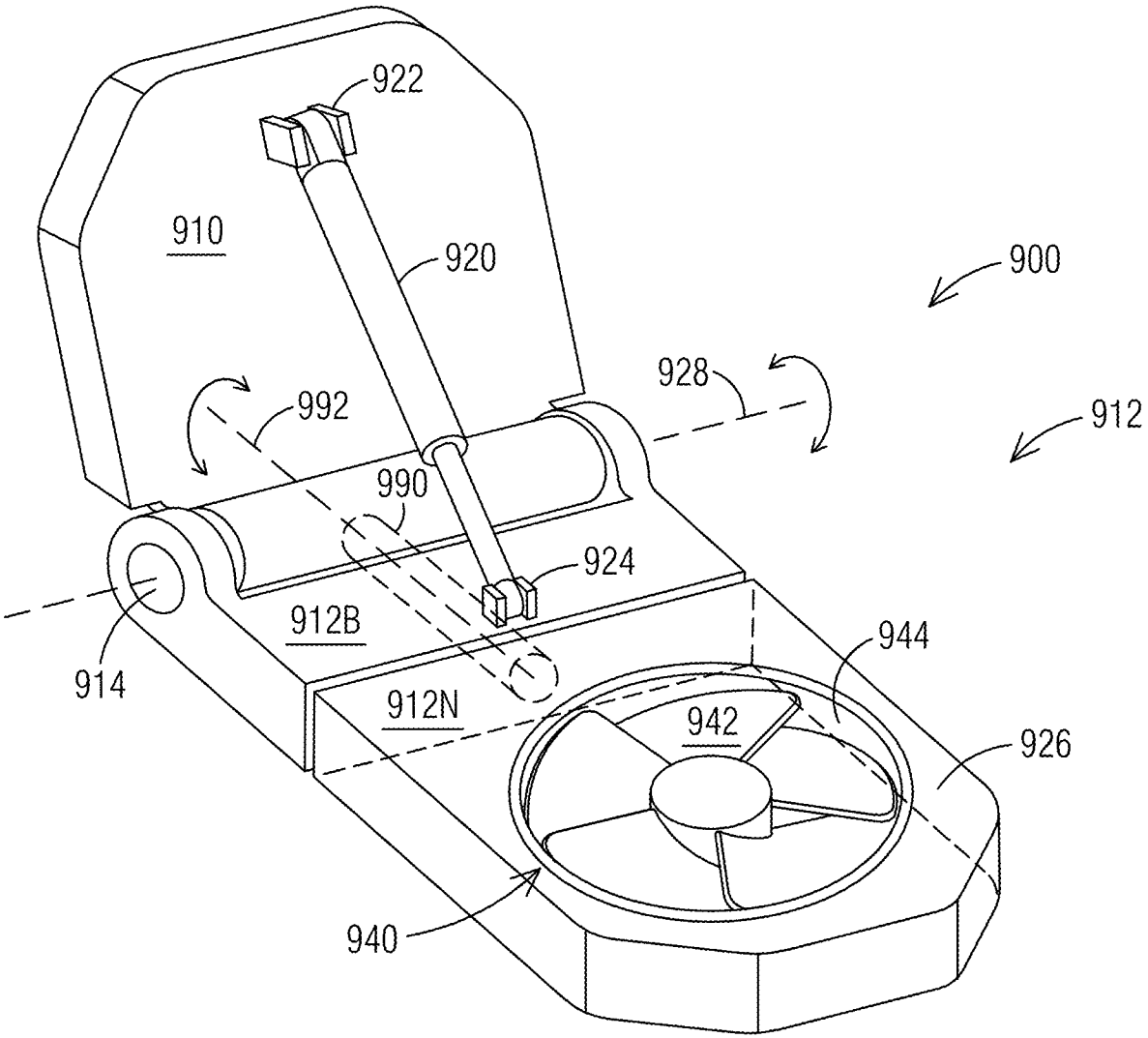
FIG. 9 is a schematic perspective view of an alternate example embodiment of a trim tab assembly.

FIG. 9 is a schematic perspective view of an alternate example embodiment of the trim tab assembly 900 that operates like the example embodiment of FIG. 5. In this example embodiment, the trim tab assembly 900 includes the mounting base 910, a trim tab 912 that is divided into a base section 9128 and a nozzle section 912N, the first pivot joint 914, and the first actuator 920 (e.g., a linear actuator) with the base pivot mount 922 secured to the mounting base 910 and with the tip pivot mount 924 that is secured to the base section 9128. The trim tab assembly 900 also includes the axial flow pump 940 having the propeller 942 and the surrounding duct 944 mounted on the dorsal side 926 of the trim tab 912. (Nozzles within the perimeter of the duct 944 are present but not visible.)

As with the example embodiment of FIG. 1, extending and retracting the first actuator 920 respectively lowers and raises the trim tab 912 by pivoting the trim tab 112 about the pivot axis 928. Also present is the second actuator 990 (e.g., a rotary actuator) disposed on or in the base section 9128. The second actuator 990 rotates the nozzle section 912N about the second pivot axis 992 to laterally orient the nozzles. As with all example embodiments, actuation of the first actuator 920 and the second actuator 990 can occur independently of each other.

Figure 10:
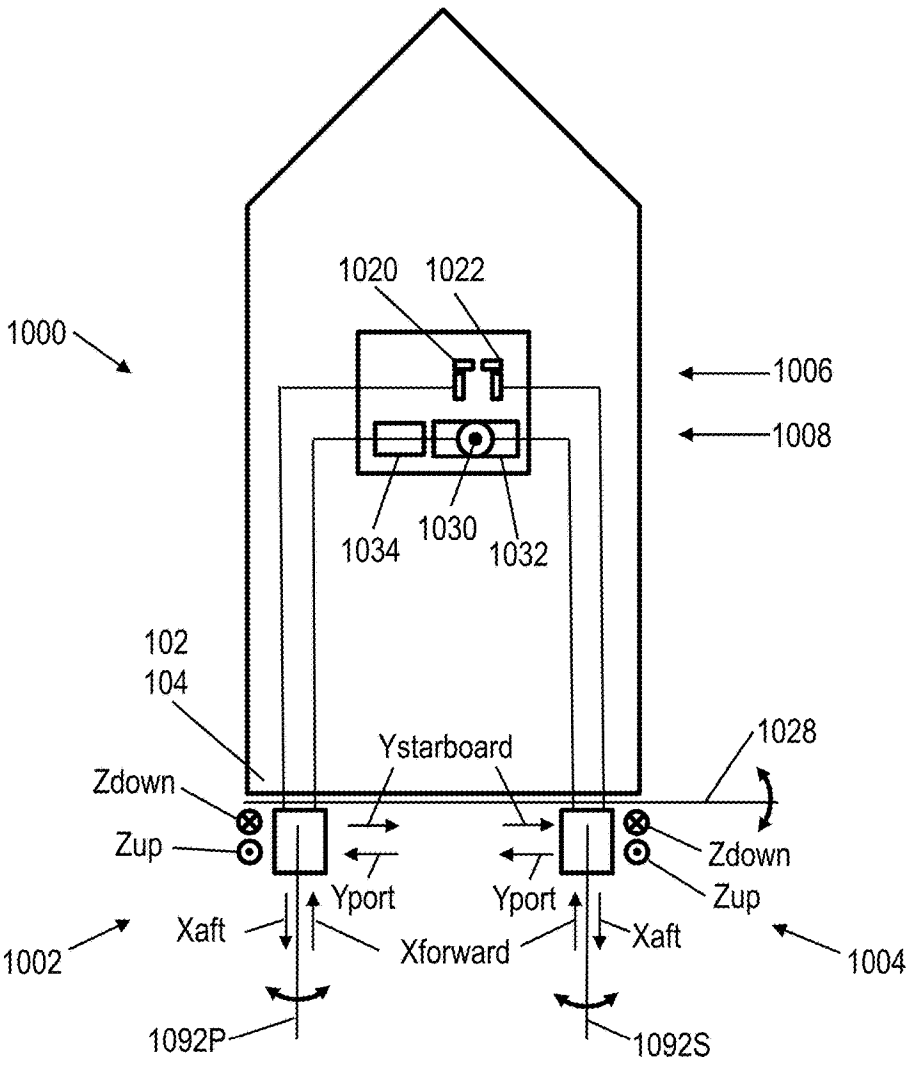
FIG. 10 is a schematic top view of an example embodiment of a trim tab system on a marine vessel.

FIG. 10 is a schematic top view of an example embodiment of a trim tab system 1000 on the marine vessel 104. The trim tab system 1000 includes a port trim tab assembly 1002, a starboard trim tab assembly 1004, and at least one of a first control system 1006 and a second control system 1008.

The first control system 1006 includes a port manual actuator, throttle, and direction control 1020 in operational communication with and configured to provide independent manual control of the actuators of the port trim tab and the speed and direction of rotation of a port axial flow pump of the port trim tab assembly 1002. The first control system 1006 also includes a starboard manual actuator, throttle, and direction control 1022 in communication with and configured to provide independent manual control of the actuators of the starboard trim tab and speed and direction of rotation of a starboard axial flow pump of the starboard trim tab assembly 1004. The port manual actuator, throttle, and direction control 1020 and the starboard manual actuator, throttle, and direction control 1022 operate independently of each other.

The second control system 1008 includes an integrated manual control 1030 (e.g., a joystick control) in operational communication with and configured to independently control the respective actuators and directions and speed of rotation of the respective bidirectional flow pumps. An integrated manual control 1030 allows a user to move the control in a desired direction of movement of the marine vessel 104 and select a desired speed. The integrated manual control 1030 coordinates the actuators and the directions and speeds of the port axial flow pump and the starboard axial flow pump independently of each other to move the marine vessel 104 in accord with the input from the operator. The coordination can be via mechanical linkage(s) and/or a computer controller 1034.

In addition to independent control of the direction and speed of rotation of the respective axial flow fans, each of the port trim tab assembly 1002 and the starboard trim tab assembly 1004 is selectively and independently pivotable about the first pivot axis 1028. Likewise, each of the port trim tab assembly 1002 and the starboard trim tab assembly 1004 is selectively and independently pivotable about the respective second axis 1092P, 1092S. The result is that each trim tab assembly 1002, 1004 can simultaneously, selectively, and independently generate a respective force (Xforward, Xaft, Ystarboard, Yport, Zup, Zdown) along each of up to three axes and in a variety of magnitudes.

Consequently, the trim tab system 1000 not only operate as traditional trim tabs, but they enable the operator to use the port trim tab assembly 1002 and the starboard trim tab assembly 1004 to maneuver the marine vessel 104 like how an operator can use two or more outboard engines to maneuver the marine vessel 104. For at least these reasons, this represents an improvement in the art.

Figure 11:
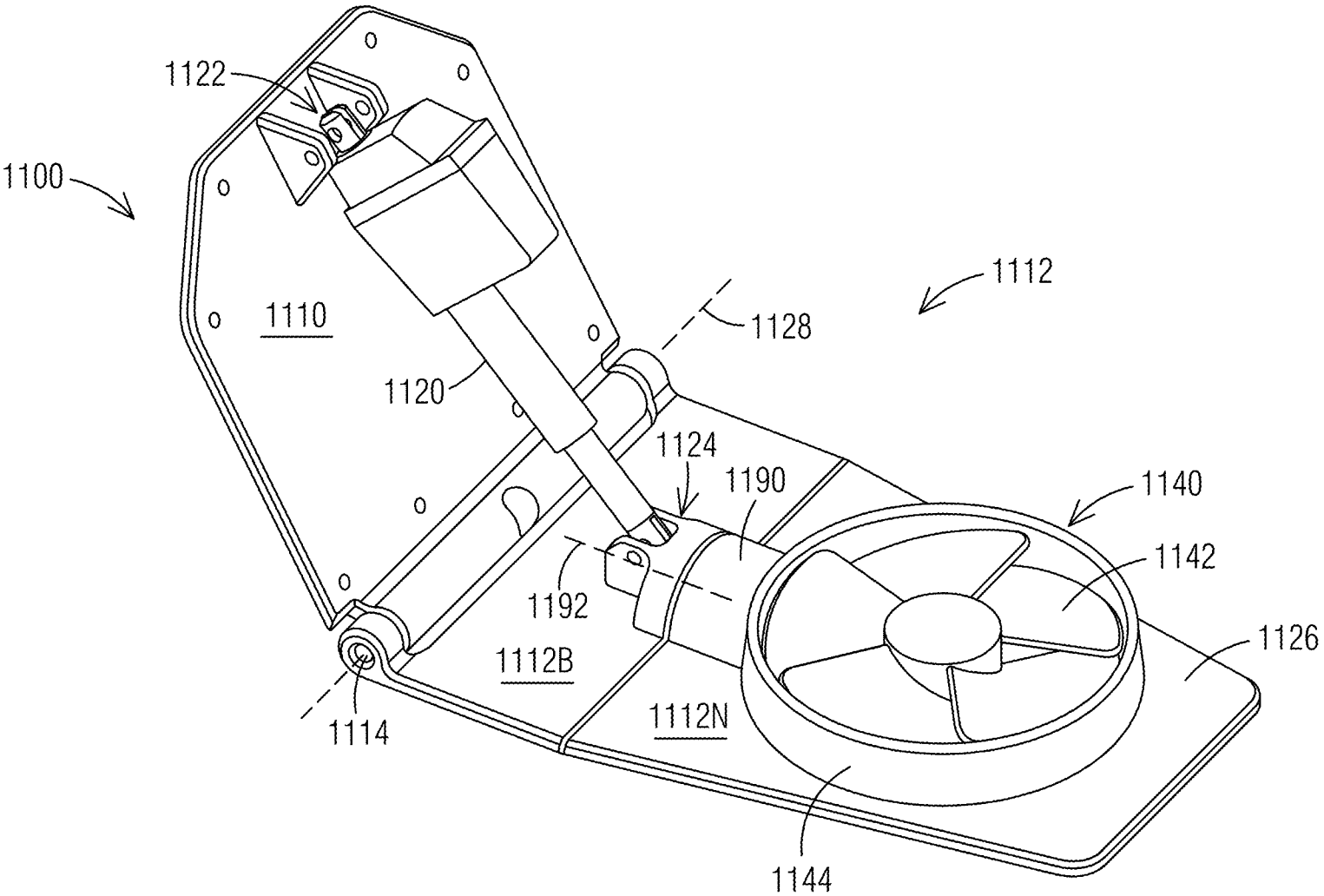
FIG. 11 and FIG. 12 are schematic perspective views of an alternate example embodiment of a trim tab assembly.
Figure 12:
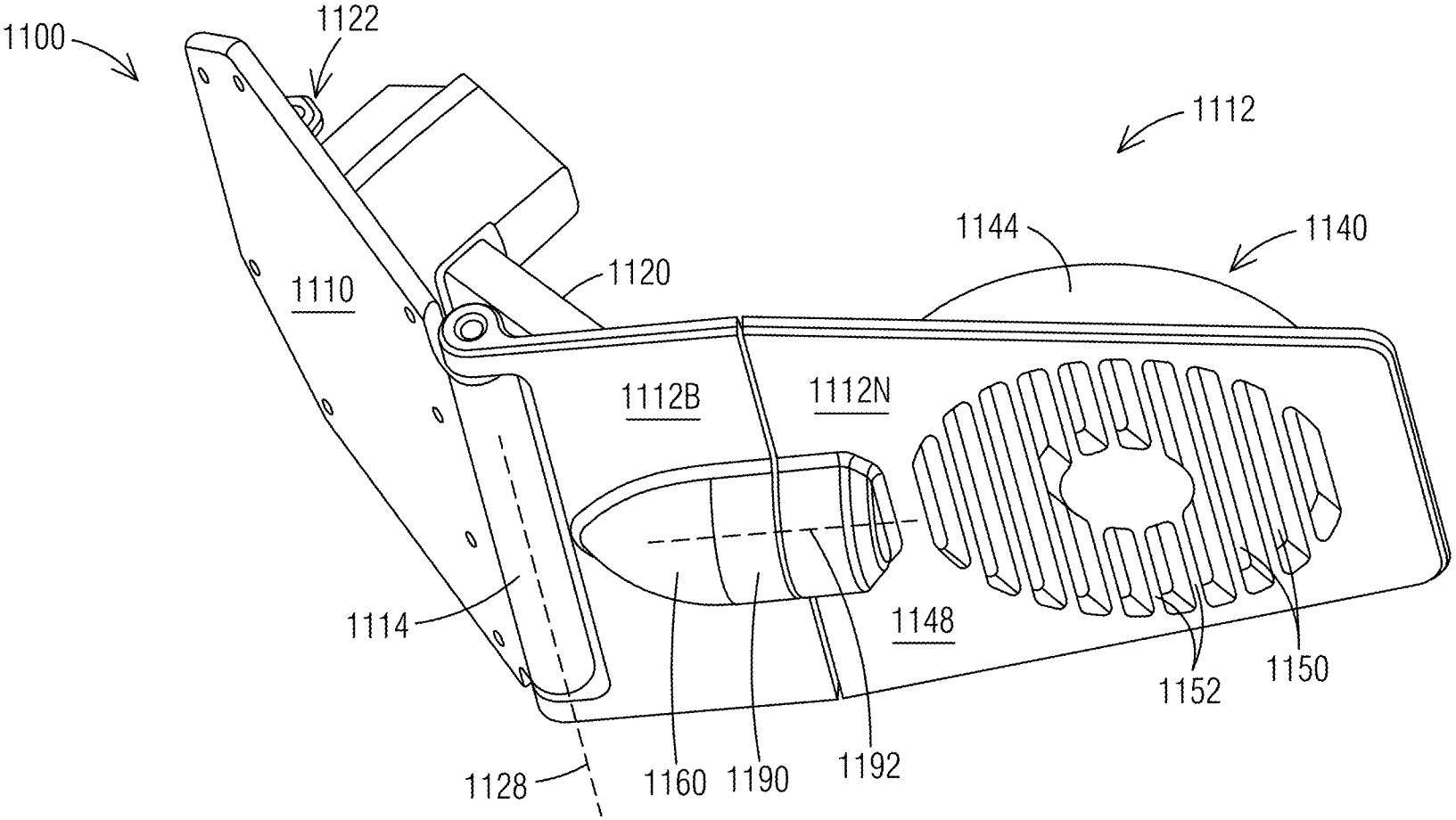

FIG. 11 and FIG. 12 are schematic perspective views of an alternate example embodiment of a trim tab assembly 1100. In this example embodiment, the trim tab assembly 1100 includes the mounting base 1110, a trim tab 1112 that is divided into a base section 1112B and a nozzle section 1112N, the first pivot joint 1114, and the first actuator 1120 (e.g., a linear actuator) with the base pivot mount 1122 secured to the mounting base 1110 and with the tip pivot mount 1124 that is secured to the base section 1112B. The trim tab assembly 1100 also includes the axial flow pump 1140 having the propeller 1142 and the surrounding duct 1144 mounted on the dorsal side 1126 of the trim tab 1112. Nozzles 950 are disposed within the perimeter of the duct 1144 between vanes 950.

As with the example embodiment of FIG. 9, extending and retracting the first actuator 1120 respectively lowers and raises the trim tab 1112 by pivoting the trim tab 1112 about the pivot axis 1128. Also present is the second actuator 1190 (e.g., a rotary actuator) that can be disposed on or in the base section 1112B, on or in the nozzle section 1112N, or on or in both the base section 1112B and the nozzle section 1112N. In this example embodiment, the second actuator 1190 is disposed within an enclosure feature 1160 that spans both the base section 1112B and the nozzle section 1112N. The enclosure feature 1160 includes a smoothed/aerodynamic shape on the ventral side 1148 of the trim tab 1112 to reduce resistance as the trim tab 1112 moves through the water.

In this example embodiment, the second actuator 1190 may include a motor (electric, pneumatic, hydraulic etc.) (not shown) disposed in the base section 1112B and a shaft (not shown) actuated by the motor and connected to the nozzle section 1112N. However, the reverse is equally possible. The second actuator 1190 rotates the nozzle section 1112N about the second pivot axis 1192 to laterally orient the nozzles. As with all example embodiments, actuation of the first actuator 1120 and the second actuator 1190 can occur independently of each other.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising at least one trim tab assembly, each comprising:

a mounting base configured to be mounted to a stern of a marine vessel;

a trim tab comprising a nozzle;

a pivot joint configured to raise and lower the trim tab relative to the mounting base;

an axial flow pump configured to direct a medium flow through the nozzle;

a base section connected at a mount end to the mounting base via the pivot joint;

a nozzle section comprising the nozzle; and a rotary joint between the base section and the nozzle section.

2. The apparatus of claim 1, wherein the rotary joint is configured to rotate the nozzle section at least 90 degrees from a neutral position to face one lateral side and at least 90 degrees from the neutral position to face another lateral side.

3. The apparatus of claim 2, wherein the rotary joint is configured to rotate the nozzle section 360 degrees.

4. The apparatus of claim 1, further comprising:

a first actuator configured to raise and lower the trim tab by pivoting the trim tab about the pivot joint; and a second actuator configured to rotate the nozzle section via the rotary joint.

5. The apparatus of claim 1, wherein the axial flow pump is disposed on a dorsal side of the trim tab;

wherein the trim tab further comprises an array of nozzles comprising the nozzle; and wherein from the dorsal side to a ventral side of the trim tab nozzles of the array of nozzles are angled away from the pivot joint.

6. The apparatus of claim 1, wherein the axial flow pump comprises a ducted fan.

7. The apparatus of claim 6, wherein the trim tab comprises a duct of the ducted fan.

8. The apparatus of claim 1, wherein the axial flow pump comprises a bidirectional axial flow pump.

9. The apparatus of claim 1, wherein the pivot joint is configured to rotate the trim tab down at least to a vertical position.

10. The apparatus of claim 1, wherein the at least one trim tab assembly comprises a port trim tab assembly and a starboard trim tab assembly;

wherein each axial flow pump comprises a respective bidirectional flow pump; and wherein the apparatus is configured to permit independent control of a direction of rotation of the respective bidirectional flow pumps.

11. The apparatus of claim 10, the apparatus further comprising:

a port manual direction control configured to provide independent manual control of the direction of rotation of a port axial flow pump; and a starboard manual direction control that is configured to provide independent manual control of the direction of rotation of a starboard axial flow pump.

12. The apparatus of claim 11, wherein the port manual direction control is further configured to provide independent manual control of a speed of the port axial flow pump; and wherein the starboard manual direction control is further configured to provide independent manual control of a speed of the starboard axial flow pump.

13. The apparatus of claim 10, the apparatus further comprising an integrated manual control configured to independently control the respective directions of rotation of the respective bidirectional flow pumps.

14. An apparatus, comprising:

a mounting base configured to be mounted to a stern of a marine vessel;

a trim tab comprising an array of nozzles therethrough;

a pivot joint between the mounting base and the trim tab and configured to raise and lower the trim tab; and an axial flow pump disposed on a dorsal side of the trim tab and configured to direct a medium flow through the array of nozzles;

wherein from the dorsal side to a ventral side of the trim tab nozzles of the array of nozzles are angled away from the pivot joint.

15. The apparatus of claim 14, wherein the pivot joint is configured to rotate the trim tab down at least to a vertical position.

16. The apparatus of claim 15, wherein the pivot joint is configured to rotate the trim tab down and past the vertical position.

17. The apparatus of claim 16, wherein the pivot joint is configured to rotate the trim tab down and past the vertical position until the nozzles are oriented horizontally.

18. The apparatus of claim 14, further comprising a rotary joint configured to rotate at least a portion of the trim tab about a discrete axis of rotation.

19. The apparatus of claim 18, wherein the trim tab comprises a nozzle section that comprises the array of nozzles; and wherein the rotary joint is secured to and configured to rotate the nozzle section.

20. The apparatus of claim 19, wherein the rotary joint is configured to rotate the nozzle section at least 90 degrees from a neutral position to face one lateral side and at least 90 degrees from the neutral position to face another lateral side.

21. The apparatus of claim 14, wherein the axial flow pump comprises a ducted fan; and wherein the trim tab comprises a duct of the ducted fan.

22. An apparatus, comprising at least one trim tab assembly, each comprising:

a mounting base configured to be mounted to a stern of a marine vessel;

a trim tab comprising a nozzle;

a pivot joint configured to raise and lower the trim tab relative to the mounting base;

an axial flow pump configured to direct a medium flow through the nozzle;

wherein the at least one trim tab assembly comprises a port trim tab assembly and a starboard trim tab assembly;

wherein each axial flow pump comprises a respective bidirectional flow pump; and wherein the apparatus is configured to permit independent control of a direction of rotation of the respective bidirectional flow pumps;

the apparatus further comprising a port manual direction control configured to provide independent manual control of the direction of rotation of a port axial flow pump and a starboard manual direction control that is configured to provide independent manual control of the direction of rotation of a starboard axial flow pump.

23. An apparatus, comprising at least one trim tab assembly, each comprising:

a mounting base configured to be mounted to a stern of a marine vessel;

a trim tab comprising a nozzle;

a pivot joint configured to raise and lower the trim tab relative to the mounting base;

an axial flow pump configured to direct a medium flow through the nozzle;

wherein the at least one trim tab assembly comprises a port trim tab assembly and a starboard trim tab assembly;

wherein each axial flow pump comprises a respective bidirectional flow pump; and wherein the apparatus is configured to permit independent control of a direction of rotation of the respective bidirectional flow pumps;

the apparatus further comprising an integrated manual control configured to independently control the respective directions of rotation of the respective bidirectional flow pumps.

* * * * *